United States Patent [19]

Cetrone

[11] Patent Number: 4,712,165

[45] Date of Patent: Dec. 8, 1987

[54] TUBULAR OVERHEAD LIGHTING SYSTEM

[76] Inventor: Vincent B. Cetrone, 442 Fairway Dr. NE., Warren, Ohio 44483

[21] Appl. No.: 903,599

[22] Filed: Sep. 5, 1986

[51] Int. Cl.[4] ..... H01H 47/00

[52] U.S. Cl. ..... 362/147; 362/217; 362/219; 362/222

[58] Field of Search ..... 126/147–150, 126/217–222, 382, 322, 225, 238, 239, 311

[56] References Cited

U.S. PATENT DOCUMENTS

| | | | |
|---|---|---|---|
| 831,821 | 9/1906 | Beuttell | 362/219 |
| 2,337,745 | 12/1943 | Garstang | 362/217 |
| 2,560,877 | 7/1951 | Kurtzon | 362/217 |
| 3,504,172 | 3/1970 | Liberman | 362/150 |
| 3,949,216 | 4/1976 | Howe | 362/222 |
| 4,074,124 | 2/1978 | Maute et al. | 362/217 |
| 4,109,305 | 8/1978 | Claussen et al. | 362/404 |
| 4,161,769 | 7/1979 | Elliott | 362/219 |
| 4,337,503 | 6/1982 | Turner | 362/217 |
| 4,420,798 | 12/1983 | Herst et al. | 362/147 |
| 4,558,400 | 12/1985 | Buser | 362/222 |
| 4,597,035 | 6/1986 | Lettenmeyer | 362/219 |

FOREIGN PATENT DOCUMENTS

| | | | |
|---|---|---|---|
| 812392 | 8/1951 | Fed. Rep. of Germany | 362/219 |
| 840384 | 4/1952 | Fed. Rep. of Germany | 362/219 |
| 962188 | 7/1950 | France | 362/219 |

*Primary Examiner*—James C. Yeung

*Attorney, Agent, or Firm*—Harpman & Harpman

[57] ABSTRACT

An inexpensive, lightweight, overhead lighting system positions fluorescent tubes and their associated ballasts in slotted plastic pipes arranged in end to end relation and connected and supported by plastic pipe fittings, including ells, tees, angles and cross shaped sections which are in turn suspended beneath a ceiling or roof of a structure by appropriate support rods and tubes.

1 Claim, 6 Drawing Figures

TUBULAR OVERHEAD LIGHTING SYSTEM

BACKGROUND OF THE INVENTION

1. Technical Field

This invention relates to a lighting system such as suspended beneath a ceiling of an enclosure and incorporating fluorescent tubes as a light source.

2. Description of the Prior Art

Prior lighting systems usually employ elongated or rectangular metal fixtures positioned on a ceiling or suspended therebelow and incorporating fluorescent tubes and the ballasts necessary for the operation thereof. Such systems have also been utilzed to support a plurality of spaced incandescent or similar light sources. See for example U.S. Pats. Nos. 3,504,172, 4,109,305, and 4,420,798.

U.S. Pat. No. 3,504,172 discloses a grid section of metal fixtures incorporating a plurality of individual light units.

U.S. Pat. No. 4,109,305 discloses elongated metal boxes and a support frame therefor hidden in or above a decorative ceiling and utilizes fluorescent tubes as a light source.

U.S. Pat. No. 4,420,798 discloses cross sectionally circular extruded aluminum fixtures in which fluorescent tubes are positioned with novel hanger elements engaging the sides and ends of the extruded shapes so that they can be joined in a grid-like arrangement.

The present invention eliminates the cumbersome, relatively heavy, expensive metal fixtures and forms a tubular overhead lighting system in many configurations utilizing plastic pipe and plastic fittings connecting several sections of the plastic pipe to one another. Fluorescent tubes and their ballasts are positioned in the plastic pipe which is slotted to desirably direct the light downwardly, upwardly, or sidewardly as the case may be.

SUMMARY OF THE INVENTION

A tubular overhead lighting system is formed of inexpensive, lightweight sections of plastic pipe slotted longitudinally inwardly of its ends and supported by plastic pipe fittings in a desirable grid configuration. The fittings, such as ells, tees, angles and the like, are supported by rods or tubes from a ceiling of the enclosure to be illuminated and fluorescent tubes and their necessary ballasts are positioned in the slotted plastic pipe and the end fittings.

DESCRIPTION OF THE PREFERRED EMBODIMENT

Figure 1:
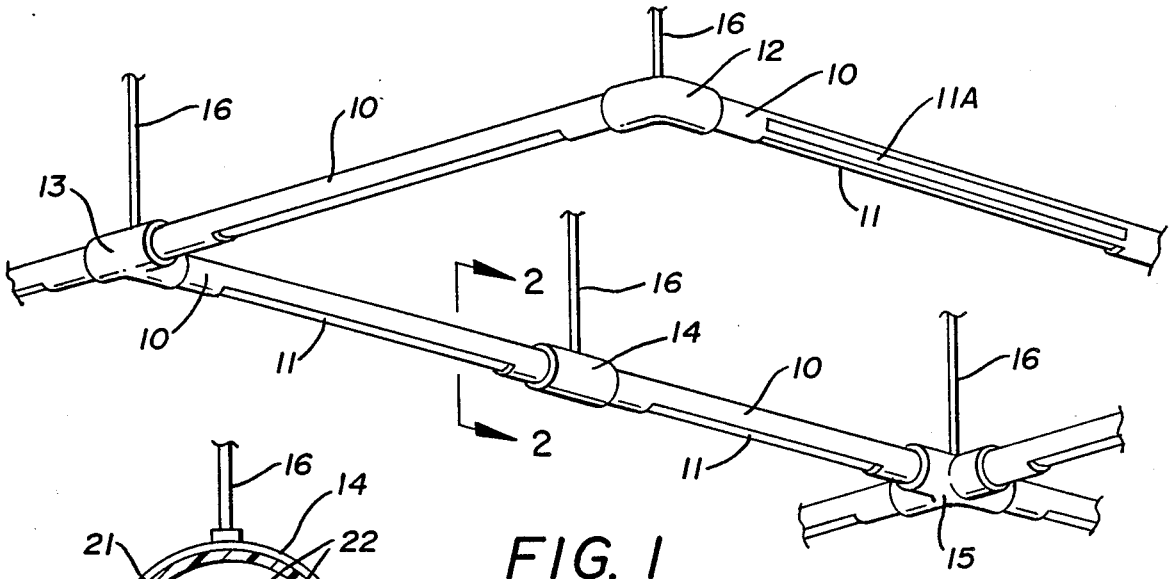
FIG. 1 is a perspective view of a tubular overhead lighting system showing sections of slotted plastic pipe and plastic fittings engaging the same and tubes suspending the fittings from an overhead support.

By referring to the drawings and FIG. 1 in particular, a tubular overhead lighting system will be seen to comprise several elongated pieces of plastic pipe 10, each of which has one or more elongated slots 11 therein so as to direct light from a fluorescent tube in the plastic pipe in a desired direction, such as downwardly in FIG. 1 of the drawings. The sections of plastic pipe 10 are preferably pvc drainage pipe of a 4″ inner diameter. The sections are formed in a desirable grid utilizing plastic pipe fittings such as ells 12, tees 13, nipples 14, and cross shaped fittings 15 and it will occur to those skilled in the art that angular fittings, not shown, may be used when a grid lighting system is formed wherein an angle greater than a right angle is necessary.

It will occur to those skilled in the art that in addition to the elongated slots 11 in the bottom surfaces of the overhead lighting system, the sections of plastic pipe may be rotated so that the light emitting slots face sidewardly or upwardly as for example where it is desirable to illuminate a side wall or a ceiling above the lighting system.

Figure 3:
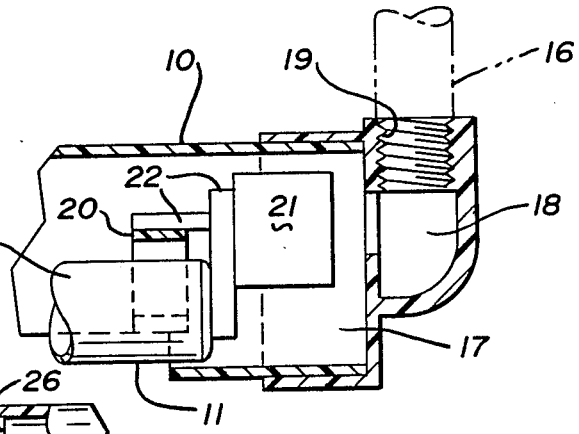
FIG. 3 is an enlarged section of an end of the slotted plastic pipe, an end cap thereon having a molded threaded receptacle for a tubular support.

Additionally, more than one elongated slot 11 may be formed in one or more of the plastic pipes 10 as seen in the upper right hand portion of FIG. 1 wherein a secondary light emitting slot 11A is formed in one side of the plastic pipe 10. Vertical support members 16, such as plastic or aluminum tubes, supported at their upper ends by suitable brackets attached to the ceiling or other suitable overhead supports are attached at their lower ends to the several fittings 12–15 and the like which in turn support the slotted plastic pipes 10. When individual slotted plastic pipes are used, end caps 17 as shown in FIG. 3 may be provided and may incorporate communicating housings 18 having circular openings 19 in which plastic or metal tubes 16 may be engaged. The openings 19 and tubes 16 may be threaded or contact cement may be used.

Figure 2:
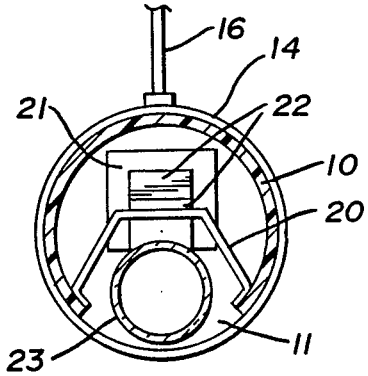
FIG. 2 is an enlarged cross section on line 2—2 of FIG. 1 illustrating a fluorescent tube, a ballast therefor, and a bracket supporting the same in the slotted plastic pipe.

By referring to FIG. 2 of the drawings, an enlarged cross section on line 2—2 of FIG. 1 may be seen to illustrate the plastic pipe 10, the slot 11 in the lower portion thereof, and the supporting sleeve or nipple 14 as hereinbefore described.

In FIG. 2 of the drawings, an inverted generally U-shaped bracket 20 straddles the slot 11 in the plastic pipe 10 and supports a ballast 21 and/or a fluorescent tube mounting socket 22 which in turn supports one end of a fluorescent tube 23. A pair of the brackets 20 are provided for each of the fluorescent tubes 23 which are preferably of lengths, such as 8′, slightly longer than the lengths of the slots 11 in the plastic pipes 10. Those skilled in the art will observe that the total weight of the plastic pipes 10, the supporting fittings 12–15, the brackets 20 and the fluorescent tubes 23 which form the principal sections of the tubular overhead lighting system is a great deal less than any comparable metal fluorescent lighting fixture heretofore known.

Figure 5:
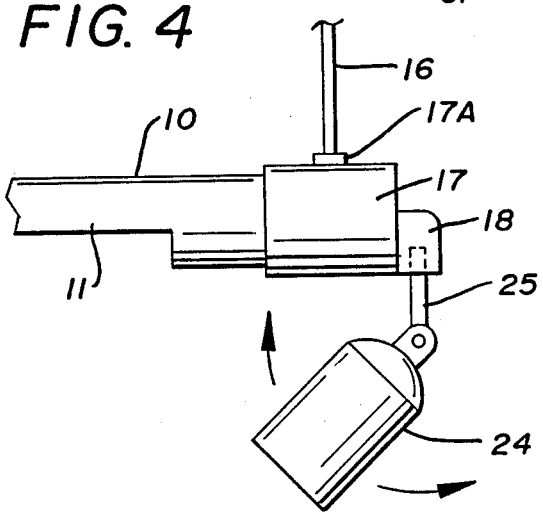
FIG. 5 is a side elevation of an end portion of the slotted plastic pipe and end fittings and a spotlight mounted thereon.

In FIG. 5 of the drawings, the end cap 17 as hereinbefore described in connection with FIG. 3 has been modified by the addition of a receptacle 17A thereon for the reception of the support tube 16 and the housing 18 and its threaded socket 19 used to support a spotlight 24 on a hinged arm 25, the other end of the end cap 17 receiving one end of the plastic pipe 10 having the elongated slot 11 therein through which light from a fluorescent tube therein is directed.

Figure 6:
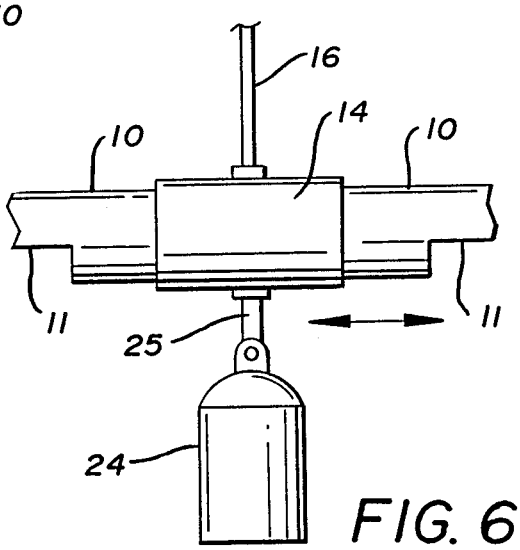
FIG. 6 is a side elevation of a pair of slotted plastic pipes, a tubular fitting joining the same and having a spotlight attachment secured thereto.

In FIG. 6 of the drawings, the spotlight 24 and its hinged arm 25 are attached to the periphery of the sleeve or nipple 14 which also has a support rod or tube 16 engaged thereon. Two sections of the plastic pipe 10 are shown engaged in the nipple or sleeve 14, each having an elongated light emitting slot 11 of a width at least one quarter of the circumference.

It will occur to those skilled in the art that the plastic pipe 10 used in forming the tubular overhead lighting system of this invention is widely available as a white pvc (polyvinyl chloride) material with a smooth interior and exterior surface and that the interior surface forms an excellent reflector for the light emitted by the fluorescent tube 23. The reflected light directed sidewardly and upwardly from the fluorescent tube is thus redirected by the interior surface of the plastic pipe 10 as the same forms a very effective light reflecting surface serving to direct the reflected light outwardly of the elongated slot 11 and thus increase the lighting efficiency of the lighting system.

Figure 4:
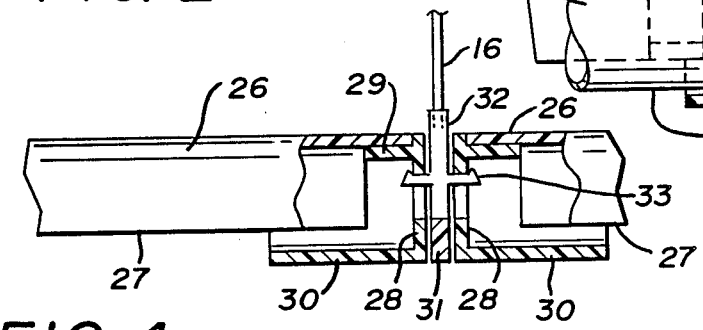
FIG. 4 is a side elevation with parts broken away of an end of the slotted plastic pipe of the system and an end support engaged therein with an extending tab registering with a portion of the slot in the pipe.

Modifications of the invention disclosed herein are possible, and one such modification is illustrated in Figure 4 of the drawings wherein a plastic pipe 26 is formed with a continuous elongated slot 27 therein. Fittings, like those hereinbefore described, are used to join the ends of the continuously slotted pipe 26 to one another and as illustrated in FIG. 4 of the drawings, one of the fittings comprises an end cap 28 having an annular flange 29 for registry within the end of the continuously slotted pipe 26. An extending tab 30 of the same width as the slot 27 acts as a filler for the end portion thereof and increases the diameter of the annular flange 29 in corresponding degree so that a smooth, attractive end support is achieved. Duplicate end caps 28 may be apertured for communication and joined together and supported by an annular fitting 31 having a receptacle 32 on its periphery for the reception of a support tube 16 and including resilient latch arms 33 which hold the end caps to one another. Such end caps may thus be used singularly or in pairs as necessary in assembling several continuously slotted pipes 26 to one another in a tubular overhead lighting system.

The plastic material is preferably light reflective but may be translucent.

Although but two embodiments of the present invention have been illustrated and described, it will be apparent to those skilled in the art that various changes and modifications may be made therein without departing from the spirit of the invention and having thus described my invention, what I claim is:

1. In a tubular lighting system having at least one plastic pipe of a known circumference with a longitudinally extending slot therein of a width at least equal to one-fourth of said known circumference of said plastic pipe and means for suspending said plastic pipe from an overhead support, the improvement comprising longitudinally spaced inverted generally U-shaped brackets positioned in said plastic pipe and straddling said slot therein, a tubular light source in said plastic pipe supported by said generally U-shaped brackets, said tubular light source being in partial registry with said elongated slot and means including an electric circuit for energizing said tubular light source.

* * * * *